United States Patent [19]

Minick et al.

[11] Patent Number: 4,542,832

[45] Date of Patent: Sep. 24, 1985

[54] STORAGE ACCESSORIES FOR MOVABLE PARTITION SYSTEMS

[75] Inventors: Harold N. Minick, Tryon, N.C.; Douglas F. Wolff, Marshall, Mich.

[73] Assignee: Wolff Wire Corporation, Ludington, Mich.

[21] Appl. No.: 411,592

[22] Filed: Aug. 26, 1982

[51] Int. Cl.[4] ..... A47F 5/08

[52] U.S. Cl. ..... 211/106; 211/181

[58] Field of Search ..... 211/106, 180, 181, 55, 211/10, 11; 312/183

[56] References Cited

U.S. PATENT DOCUMENTS

| | | | |
|---|---|---|---|
| 562,933 | 6/1896 | Stone | 211/55 X |
| 1,465,691 | 8/1923 | Snedeker | 211/10 X |
| 1,713,897 | 5/1929 | French | 312/183 |
| 2,210,235 | 8/1940 | Filbert | 248/224.1 |
| 2,279,897 | 4/1942 | Ammon | 211/10 |
| 3,115,107 | 12/1963 | Glenny | 211/106 X |
| 3,240,260 | 3/1966 | Rabinow | 160/166 |
| 3,482,705 | 12/1969 | Bushey | 211/88 X |
| 4,232,596 | 11/1980 | Kroll et al. | 211/10 X |
| 4,415,091 | 11/1983 | Wolff | 211/106 X |

*Primary Examiner*—J. Franklin Foss
*Assistant Examiner*—David L. Talbott
*Attorney, Agent, or Firm*—Price, Heneveld

[57] ABSTRACT

The invention provides accessories for suspension from beams mounted on either space divider panels or a stand with the individual accessory units being readily movable from one support to another or in some cases being capable of being temporarily placed on a supporting surface while their content is being actively utilized.

4 Claims, 14 Drawing Figures

STORAGE ACCESSORIES FOR MOVABLE PARTITION SYSTEMS

BACKGROUND OF THE INVENTION

The concept of providing large, open work areas which are then subdivided into individual work areas by means of movable and rearrangable partitions has become popular in recent years. The panels used to subdivide the area and form the separation walls are normally manufactured in a variety of modular widths, such as 12, 18, 24, 30, 36, 40, 48 or 60 inches. A number of manufacturers of these panels have entered the market utilizing different modular widths. These panels are normally provided at each edge with means for detachably hanging a variety of accessory items, such as storage bins, shelving, work surfaces, bulletin boards and racks for storing or organizing various work materials such as paper. These accessories are supported by brackets designed to detachably engage and lock to slotted standards at the vertical edges of the panels.

As these type of panels have been manufactured in a variety of widths, accessories adapted to mate with the mounting brackets of one size panel will not necesssarily be adaptable to the brackets on a different size panel, requiring that numerous accessories having mounting brackets of various widths be purchased. A further complication arises from the fact that different manufacturers use different designs for the bracket supports. A system which provides for adaptability of different accessories to panels having different widths and bracket support designs, is disclosed in U.S. patent application Ser. No. 269,417, by Douglas F. Wolff, which has a common assignee as the present application. That system provides a beam which can be adapted to hook into the detachable means of various panel widths. The beam provides a plurality of identical pockets spaced along its length, and an accessory construction having a hook or hooks which are received into these pockets to support the accessory. Thus, this system allows an accessory to be used on panels of various widths.

As such panels are used in a variety of work environments, it is desirable to provide accessories that can perform a variety of functions. Although some storage devices provide for permanent storage, a desirable function is to provide temporary article support and organization for use during a particular project or daily routine. Particularly desirable would be to fulfill this function with a device which is both lightweight and inexpensive and can be adapted to a variety of work settings.

SUMMARY OF THE INVENTION

The invention provides article supports for use with a beam structure that is detachably secured to the vertical standards of panels in a space divider system. The article supports provide an organizer for work materials and the like having a number of substantially horizontal arms which are secured to the beam so as to extend outward from the wall panel. These arms are spaced along the beam and are grouped in pairs, having flexible material supported between the arms to thus form an article receiving pocket therebetween.

In one embodiment of the invention, a number of pairs of arms are spaced along the beam with one arm of each pair above the other, with the flexible material extending between alternating upper and lower arms to form an organizer including a number of article receiving pockets. In other embodiments crosspieces extend between the arms, to either form a rack for supporting numerous flexible articles or from which the flexible material depends in order to form the article receiving pocket.

In certain embodiments of the invention, the article supports have a detachable connector which can be used to connect a variety of accessories to a beam so that each article support can be used with beams having different pocket sizes or configurations.

Thus, the invention provides organizer pieces for temporary article storage while short term use is being made of the articles, such as a daily or weekly work project divider. The organizer article supports of the present invention can be supported on various widths of divider panels and replace other bulky storage items, such as file cabinets, which are hard to move should a work area be desired to be rearranged. Additionally, with storage devices of the present invention only that amount of storage area that is required need be provided. Unlike free standing file cabinets and the like, temporarily unused organizer storage devices of the present invention can easily be removed from the work area and compactly stored, since the supports nearly nest or stack for storage. Although other storage devices which are hung from movable panels can also be removed for storage, the bulky and noncollapsible structure of some, such as cupboards, do not allow for compact storage. The article supports of the present invention can be inexpensively yet sturdily made to provide a more flexible approach to work material organization.

DETAILED DESCRIPTION OF THE PREFERRED EMBODIMENT

Figure 1:
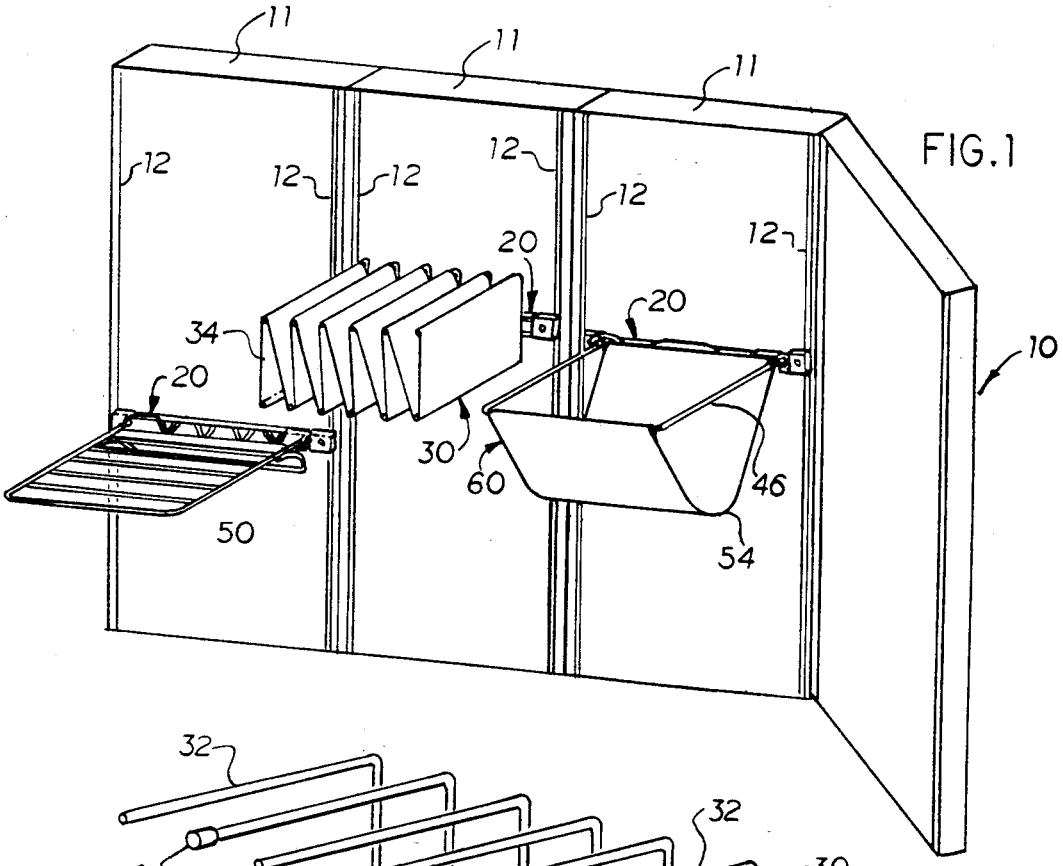
FIG. 1 is an oblique view of a portion of a space divider panel wall system illustrating embodiments of the invention installed thereon.

The numeral 10 indicates a portion of a space divider panel structure illustrating four, individual panels 11 which have been locked together to form a wall unit. The opposite vertical ends of each of the panels are provided with a slotted standard 12 of conventional construction. The slotting of the standards 12 provides the means by which various accessories such as shelving, storage cabinets, work surfaces and the like can be detachably hooked to and supported from the panels 11. This is conventional practice in this type of movable panel or partition-type, space divider construction. The width of panels 11 varies from one manufacturer to another and each particular manufacturer normally manufactures panels in several modular widths. Supported on panels 11 by beams 20 are work units or organizers such as pocket dividers 30, a computer printout rack 50 and a pouch 60. It is to be understood that the invention is not limited to these three types of work units or racks.

Figure 2:
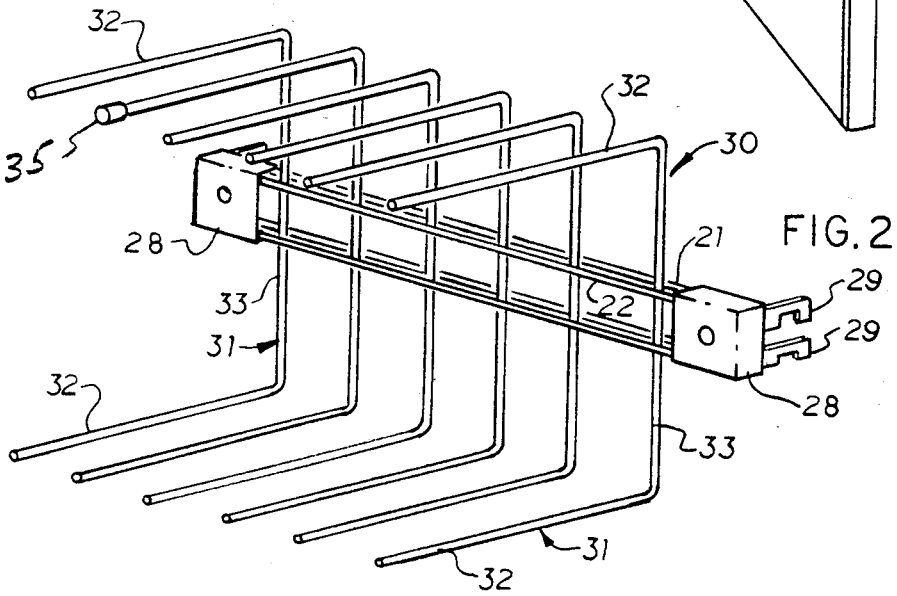
FIG. 2 is an oblique view of a beam and a frame for a divider organizer of this invention with the flexible webbing omitted.
Figure 3:
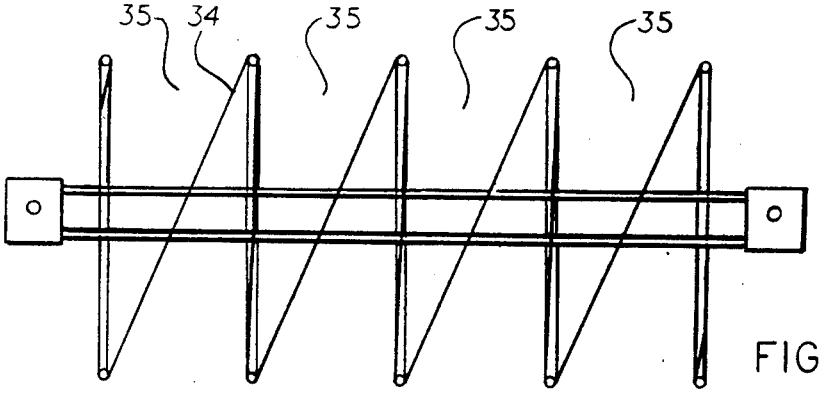
FIG. 3 is a front elevational view of the divider organizer of FIG. 2 with the flexible webbing attached.

One embodiment of the present invention includes a pocket forming divider 30 (FIGS. 2 and 3). Divider 30 has a plurality of U-shaped brackets 31 each having a pair of vertically spaced, generally horizontal arms 32 which extend outwardly from panel 11. A vertical bar 33 connects the two arms of each bracket, so that each set has an overall U-shape oriented on its side. Vertical bar 33 portion of each bracket is secured to beam 20 by being clamped between and welded to the inner and outer rails 21 and 22 of both the upper and lower members of beam 20, preferably at uniform spacings.

Flexible element or webbing 34 is passed over and around arms 31 to provide compartments or pockets 35. Flexible element 34 can be made of numerous materials, such as textile fabric, plastic or any other material which is both flexible and strong, with the strength of the material dictated by the articles to be supported. The opposite ends of the webbing 34 are looped over to form an envelope or sleeve to receive one of the arms 31. The webbing 34 is passed vertically between adjacent vertically spaced arms 31 to create generally V-shaped pockets which are open at both the top and outer ends. It is passed over the upper arms and under the lower arms. It is preferably pulled taut so the pockets will retain their shape when loaded. It will be recognized that a different arrangement of the webbing can be utilized which will change the configuration of the pockets.

Flexible webbing 34 can have enough elasticity that it can be passed over the free ends of arms 31 for removal. This allows both for the alteration of the configuration of webbing 34 on the arms and also allows dividers 30 to be nested when removed from panels 11 during storage. Plastic caps 35 (only one of which is illustrated) can be used to cover the ends of arms 31 to eliminate any sharp edges (FIG. 2).

Figure 4:
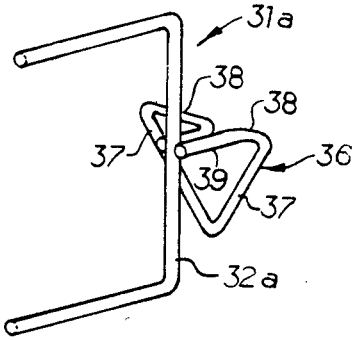
FIG. 4 is an oblique view of an individual web supporting arm pair.
Figure 5:
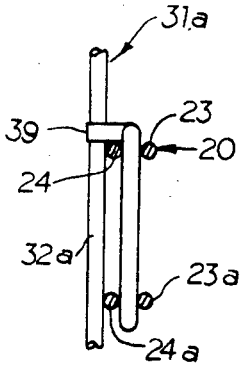
FIG. 5 is a fragmentary end elevation view of the arm pair of FIG. 4 illustrating the beam in section.

In another embodiment, shown in FIG. 4, each bracket 31*a* is independently secured to beam 20. Each bracket 31*a* is equipped with its own individual connector 36. Connector 36 has two downward convergent legs 37 which are joined at the bottom to form a V-shaped configuration corresponding in shape and size to the pockets 27 of the supporting beam. Horizontal portions 38 extend toward each other from the tops of the legs 37 and terminate in parallel outward extensions 39. Connector 36 therefore has a triangular shape which is spaced from the back face of the vertical bar portion 32*a* to provide a gap to receive the front rods or rails of the beam when the bracket is installed (FIG. 5).

Figure 6:
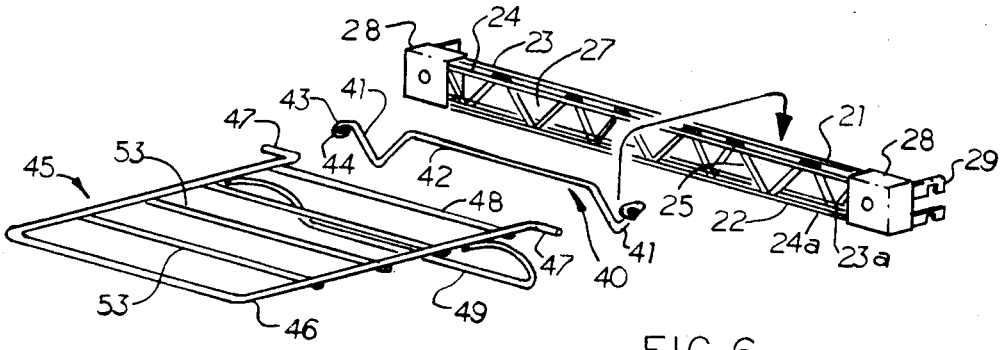
FIG. 6 is an exploded, oblique view of a rack and support unit embodying the present invention.

Beam 20 is utilized to either mount the individual brackets 31*a* or the pocket divider 30 and other accessories to panel 11 (FIG. 1). Beam 20 has inner and outer rails 21 and 22 (FIG. 6). The inner rail 21 has upper and lower rods 23 and 23*a* and the outer rail 22 has upper and lower rods 24 and 24*a* (FIG. 5). The rails are spaced apart and supported by intermediate members 25. The beam has a height adequate to stabilize racks or accessories mounted on them. The intermediate members 25 are arranged to form V-shaped pockets 27 of identical size and shape. The lower ends of adjacent segments preferably are spaced apart to provide a gap or opening through the bottom of each of the pockets 27. It will be recognized that while beam 20 preferably utilizes a wedge of V-shaped pocket 27, the pockets could be of a different shape, although the pocket sides should retain a limited degree of downwardly convergent inclination to provide positive seating of the brackets.

Each end of the beam 20 is supported by a suitable end bracket 28 (FIG. 1). Each end bracket 28 has extending therefrom a pair of hooks 29 of a size and spacing to be received in a pair of vertically spaced slots of one of the standards 12. The construction of beam 20 is more fully described in United States patent application Ser. No. 269,417, having Douglas F. Wolff as the named inventor, which application is assigned to the same assignee as the present application, the contents of which application is expressly incorporated herein by reference.

To mount each individual bracket 31*a* on beam 20, connector 36 is seated in a pocket 27. After the desired number of individual brackets 31*a* have been secured to the beam, flexible webbing is installed in the same manner as used to install it on bracket 30. In doing so, by making the webbing taut it forms panels between the arms which will hold their basic shape when loaded with work material. The use of individual brackets permits the user to select the size and number of pockets or compartments desired.

Figure 7:
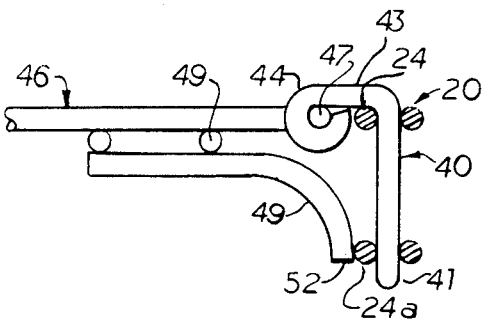
FIG. 7 is a fragmentary, sectional view illustrating the attachment of the accessory of FIG. 6 to the beam.

FIGS. 6 and 7 illustrate a detachable connector 40 for securing accessories such as racks to the beam. Detachable or releasable connect 40 has pair of spaced, downwardly extending V-shaped hooks or legs 41 sized and shaped to seat in a pair of the pockets 27 in the beam. The hooks 41 are joined by a horizontal member 42, which is of a length to space the hooks to match the spacing of the pockets 27. At each end of the releasable connector an extension 43 projects forward from the top of the hook. Although it is preferable that extension 43 rests upon upper rod 24 of the beam to provide additional support for the accessory when the connector is seated in the beam, contact between the intermediate members 25 and the hooks 41 alone is sufficient to provide positive support for the device. The terminal end of each extension 43 is bent downwardly into an eyelet 44, with extension 43 being of sufficient length that the upper rail or rod 24 can pass between the hooks 41 and eyelets 44 when connector 40 is seated on beam 20, as shown in FIG. 7. Preferably, horizontal member 43 rests on the top of the rail 24 with the eyelets 44 hanging over the front face of the beam.

Detachable connector 40 is formed from suitable steel rod. While the connector 40 must be of relatively stiff stock, it must permit the eyelets 44 to be slightly separated to mount the main body 45 of the accessory.

The main body 45 of the rack used with the detachable connector 40 includes a frame 46. The frame 46, preferably, is a generally horizontal closed loop extending outwardly from the panel. The inner ends of frame 46 terminate in laterally extending pegs 47. An inner cross piece 48 connects the sides of the frame adjacent the pegs 47 completing the loop and preventing lateral deflection of the pegs. Welded to the bottom of the frame 46 is a brace 49, which prevents frame 46 from pivoting downwardly relative to the panel when frame 46 is secured to the beam. The brace 49 is shaped such that its lower leg portion 52 seats against the front face of the beam 20, positively supporting the frame 46 against downward pivotal movement. It will be recognized that the brace can have a number of different configurations and perform the same function.

The frame 46 is secured to the connector 40 by spreading the eyelets 44 sufficiently to pass over the ends of the pegs 47. Upon release of the eyelets, they will seat over the pegs. This must be done while the connector is separated or at least partially separated from the beam 20 so that the entire hook portion of the connector is available to permit flexing. Once the hooks are seated in the pockets, they are supported against spreading by the intermediate members 25.

The article supporting means of the frame can take several forms. For example, it can be formed by a plurality of parallel cross bars 53 (FIG. 6) to form a surface or to serve as rods over which materials such as computer printout sheets can be draped. As an alternative, the cross bars 53 can be omitted and a pocket forming, flexible web 54 can be suspended between the back and front lateral members of the frame 46 to form the pouch-like accessory 60 (FIG. 1). By the addition of one or more intermediate cross members the webbing can be made to form multiple pockets or pouches.

Figure 8:
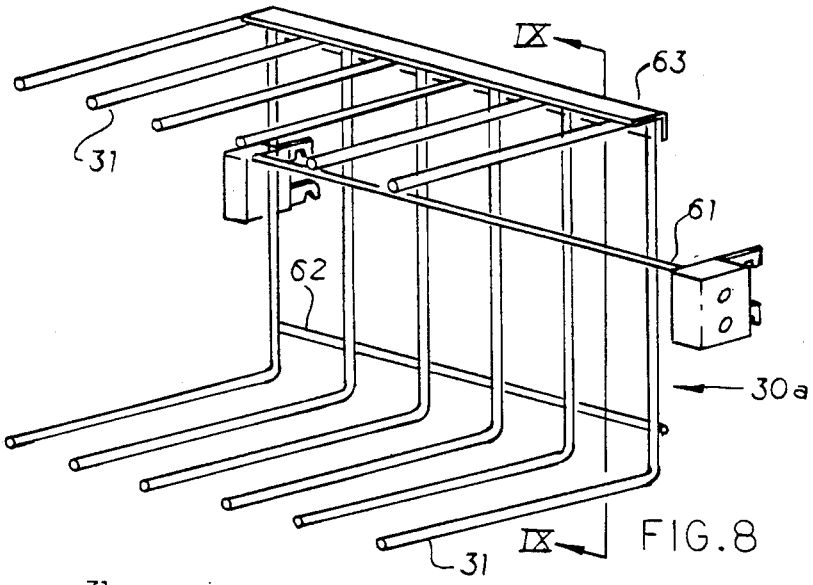
FIG. 8 is an oblique view of a modified construction for the frame illustrated in FIG. 1.
Figure 9:
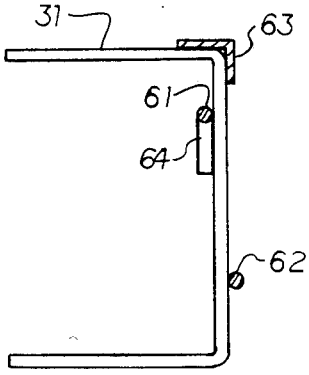
FIG. 9 is a sectional view taken along plane IX—IX of FIG. 8.

FIGS. 8 and 9 illustrate a modified construction for an accessory article support frame or rack. In this construction, the spaced brackets 31 of the accessory support 30*a* are rigidly interconnected by a rod 61 welded to their front faces a short distance below the top of the frame. They are also rigidly interconnected by a lower rod 62 welded to their back faces. The tops of the brackets are also welded to the angle member 63.

Figure 10:
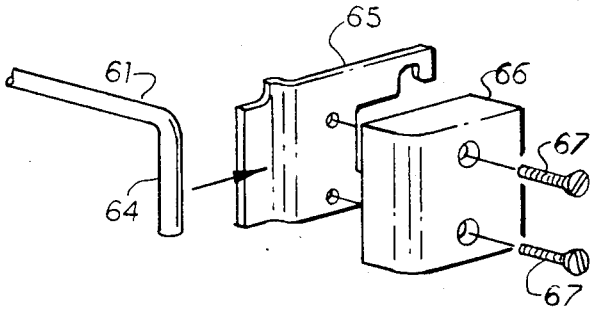
FIG. 10 is an exploded, oblique view of the support bracket for the structure illustrated in FIG. 8.

The ends of the rod 61 project beyond the adjacent brackets 31 and are turned down to form ears 64 (FIG. 10). These are clamped between the inner and outer plates 65 and 66 of the support bracket 28*a* when the plates are secured by the screws 67. The design of the bracket 28*a* may be such that the lower rod 62 bears against the panel surface when the arms of the brackets 31 are horizontal. This, however, is not essential.

Figure 11:
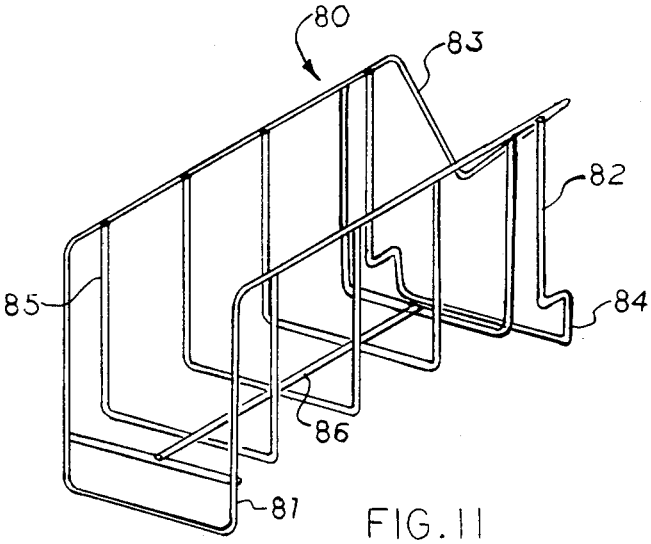
FIG. 11 is an oblique view of a further modified construction for one of the accessory units.
Figure 12:
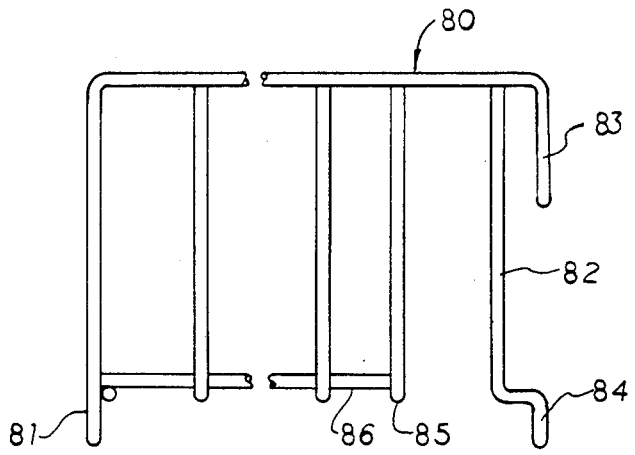
FIG. 12 is a broken, side view of the accessory shown in FIG. 11.

FIGS. 11 and 12 illustrate a further modification in which the rack 80 is a basket-type of structure having, at opposite ends, downwardly projecting legs 81 and 82. The legs project below the bottom of the rack so the accessory 80 can be detached from the beam and placed on a surface such as a desk. The accessory 80 has a hook 83 at its rear end so it can be hung from the beam. The lower portion of the rear leg 82 is offset rearwardly to provide a panel engaging brace 84 to better support the unit. The intermediate article supporting wires 85 are secured to the stabilizing rod 86 to increase the rigidity of the basket.

Figure 13:
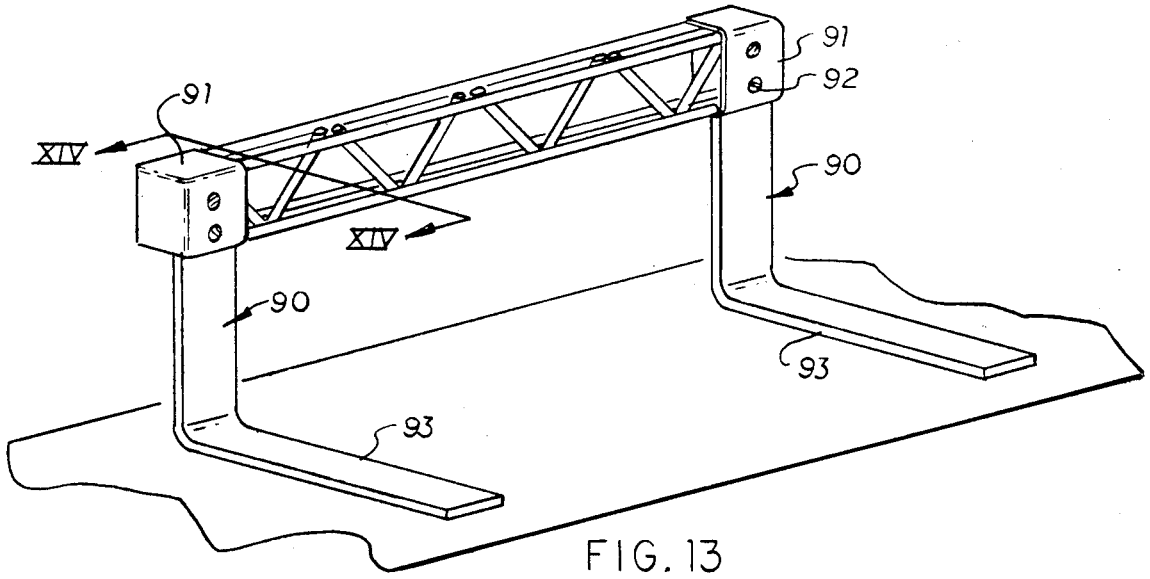
FIG. 13 is an oblique view of a stand for the accessories of this invention.
Figure 14:
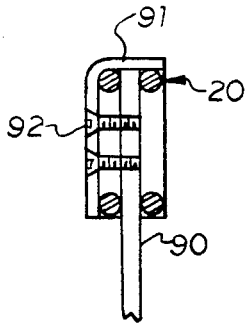
FIG. 14 is a fragmentary sectional view taken along the plane XIV—XIV of FIG. 13.

The beam can have uses other than being suspended from the panels of a space divider system. As illustrated in FIGS. 13 and 14 it can be mounted on legs 90 secured to its ends by appropriate end caps 91. The upper ends of the legs 90 are inserted between the front and rear rods of the beam 20 and are secured by tightening the screws 92 which threadedly engage the legs. This causes the front rods of the beam to be clamped between the cap and the leg. The legs are provided with long, forwardly extending feet 93 to stabilize the structure against the cantilevered loads applied by the accessory racks. This permits the beam to by supported on a suitable surface 94 such as a table or credenza.

From the above description it is apparent that the article supports incorporating this invention can perform a variety of functions. The flat rack can store flexible, hanging items such as computer printout sheets, or can be used in the manner of a conventional shelf. The pouch can store bulky items while the dividers can be used both to sort and store different groups of items. Due to the angled surface provided by the dividers, papers stored therein will stand at an angle and the top sheet will therefore be displayed. All of the article supports are manufactured of preferably steel, metal rods and abrasion and tear resistant fabric so that additional storage units are easy to erect and compact to store, while being sturdy in use.

The provision of a surface supported stand permits the units to be temporarily detached from the wall panels, moved to an active work zone and returned when no longer needed. The provision of legs on the units provides the same advantages.

From the above description and drawings of the preferred embodiment, it will be recognized that other variations or modifications can be made without departing from the principal or spirit of the invention. Such modifications are to be considered as included in the hereinafter appended claims unless these claims by their language expressly state otherwise.

The embodiments of the invention in which an exclusive property or privilege is claimed are defined as follows:

1. A rack for articles and a beam for suspending said rack and means holding said beam against rotation about its longitudinal axis, a plurality of individual brackets each having a pair of vertically aligned and spaced horizontal arms extending outwardly therefrom; said brackets being mounted on and spaced apart lengthwise of said beam; an elongated flexible web supported by and extending between the arms of all of the brackets, said web being wrapped under the lower arm and over the upper arm of each bracket to form generally vertically extending panels defining a plurality of V-shaped article receiving compartments between each adjacent bracket.

2. A rack as described in claim 1 wherein one panel of each compartment is inclined.

3. A rack as described in claim 1 wherein said beam has a plurality of pockets arranged in tandem therealong; each of said brackets having hook means for engaging one of said pockets.

4. A rack having article holding compartments of variable size and a beam for suspending said rack and means holding said beam against rotation about its longitudinal axis, a plurality of brackets, said beam having a plurality of bracket anchoring means, each bracket having a pair of vertically spaced and aligned arms extending horizontally outwardly therefrom; each bracket being secured to one of said anchoring means, said brackets being spaced apart lengthwise of said beam; an elongated flexible web supported by and extending between the arms of all of the brackets said web being wrapped under the lower arm and over the upper arm of each bracket to from generally vertically extending panels defining a plurality of V-shaped compartments between each adjacent bracket, the width of each pocket being determined by the spacing between the brackets and the brackets being moveable between one anchoring means and another for adjusting the width of the individual compartments.

* * * * *